US009478867B2

(12) United States Patent
Cooper et al.

(10) Patent No.: US 9,478,867 B2
(45) Date of Patent: Oct. 25, 2016

(54) HIGH GAIN FREQUENCY STEP HORN ANTENNA

(75) Inventors: Henry Cooper, Temecula, CA (US); Sheng Peng, Lynwood, WA (US); Ron Westberg, Temecula, CA (US); Paul Habeck, Temecula, CA (US); Floyd Phelps, Temecula, CA (US)

(73) Assignee: XI3, Salt Lake City, UT (US)

( * ) Notice: Subject to any disclaimer, the term of this patent is extended or adjusted under 35 U.S.C. 154(b) by 0 days.

(21) Appl. No.: 13/369,282

(22) Filed: Feb. 8, 2012

(65) Prior Publication Data

US 2012/0200468 A1 Aug. 9, 2012

Related U.S. Application Data

(60) Provisional application No. 61/440,598, filed on Feb. 8, 2011.

(51) Int. Cl.
*H01Q 13/10* (2006.01)
*H01Q 13/08* (2006.01)

(52) U.S. Cl.
CPC ..... *H01Q 13/085* (2013.01)

(58) Field of Classification Search
CPC ..... H01Q 1/38; H01Q 1/243; H01Q 21/064; H01Q 13/02
USPC ..... 343/767, 770, 772, 786
See application file for complete search history.

(56) References Cited

U.S. PATENT DOCUMENTS 4,437,074 A 3/1984 Cohen et al.
4,814,777 A 3/1989 Monser
4,843,403 A 6/1989 Lalezari et al.
4,853,704 A 8/1989 Diaz et al.
5,036,335 A 7/1991 Jairam
5,124,712 A 6/1992 Caille et al.
5,124,733 A 6/1992 Haneishi
5,142,255 A * 8/1992 Chang et al. ..... 333/204
5,534,880 A 7/1996 Button et al.

(Continued)

FOREIGN PATENT DOCUMENTS

CA 2244369 1/1999
EP 2673834 12/2013

(Continued)

OTHER PUBLICATIONS

Balanis, "Antenna Theory: A Review", Proc. IEEE, vol. 80, No. 1, Jan. 1992, pp. 7-23.

(Continued)

*Primary Examiner* — Dameon E Levi
*Assistant Examiner* — Hasan Islam
(74) *Attorney, Agent, or Firm* — David B. Tingey; Kirton McConkie

(57) ABSTRACT

A radiator element for RF communications formed of a planar conductive material positioned upon a planar dielectric substrate surface. Two lobes formed of the conductive material have side edges abutting a cavity decreasing in cross section between the lobes. The cavity has a widest point configured to receive RF frequencies at the lowest frequency and a narrowest point configured to receive a highest frequency of the element. Opposing pairs of notches in the side edges of the lobes along the decreasing edges of the cavity enhance the frequency of operation for frequencies paired to the distance between the pairs of notches.

18 Claims, 4 Drawing Sheets

(56) References Cited

U.S. PATENT DOCUMENTS

| | | | | |
|---|---|---|---|---|
| 5,541,611 | A * | 7/1996 | Peng et al. | 343/767 |
| 5,557,291 | A | 9/1996 | Chu et al. | |
| 5,661,494 | A | 8/1997 | Bondyopadhyay | |
| 5,845,391 | A | 12/1998 | Bellus et al. | |
| 6,191,750 | B1 | 2/2001 | Bonebright | |
| 6,351,246 | B1 | 2/2002 | McCorkle | |
| 6,396,453 | B2 | 5/2002 | Amyotte et al. | |
| 6,512,488 | B2 | 1/2003 | Schantz | |
| 6,525,696 | B2 | 2/2003 | Powell et al. | |
| 6,552,691 | B2 | 4/2003 | Mohuchy et al. | |
| 6,603,430 | B1 | 8/2003 | Hill et al. | |
| 6,724,346 | B2 | 4/2004 | Le Bolzer et al. | |
| 6,806,845 | B2 | 10/2004 | Fund et al. | |
| 6,911,947 | B1 | 6/2005 | Cranor et al. | |
| 7,057,568 | B2 | 6/2006 | Louzir et al. | |
| 7,176,837 | B2 | 2/2007 | Sonoda | |
| 7,180,457 | B2 | 2/2007 | Trott et al. | |
| 7,209,089 | B2 | 4/2007 | Schantz | |
| 7,245,266 | B1 | 7/2007 | Szente et al. | |
| 7,280,082 | B2 | 10/2007 | Theobold et al. | |
| 7,327,315 | B2 | 2/2008 | Starkie et al. | |
| 7,403,169 | B2 | 7/2008 | Svensson et al. | |
| 7,443,350 | B2 | 10/2008 | Gaucher et al. | |
| 7,450,077 | B2 * | 11/2008 | Waterhouse et al. | 343/718 |
| 7,557,755 | B2 * | 7/2009 | Han | H01Q 1/38 343/700 MS |
| 7,764,236 | B2 * | 7/2010 | Hill et al. | 343/702 |
| 7,768,470 | B2 | 8/2010 | Qin et al. | |
| 8,059,054 | B2 | 11/2011 | Mohammadian et al. | |
| 8,063,841 | B2 | 11/2011 | Peng et al. | |
| 8,138,985 | B2 | 3/2012 | Cooper | |
| 8,144,068 | B2 * | 3/2012 | Thevenard et al. | 343/767 |
| 8,149,172 | B2 * | 4/2012 | Lu et al. | 343/700 MS |
| 8,531,344 | B2 | 9/2013 | Ayatollahi et al. | |
| 8,564,491 | B2 | 10/2013 | Peng | |
| 2003/0011525 | A1 | 1/2003 | Sanad | |
| 2003/0218571 | A1 | 11/2003 | Yoon et al. | |
| 2004/0214543 | A1 | 10/2004 | Osone et al. | |
| 2004/0217911 | A1 | 11/2004 | Le Bolzer et al. | |
| 2005/0078042 | A1 | 4/2005 | Chua | |
| 2005/0099343 | A1 | 5/2005 | Asrani et al. | |
| 2005/0270243 | A1 | 12/2005 | Caimi et al. | |
| 2006/0181471 | A1 | 8/2006 | Kim et al. | |
| 2007/0018895 | A1 | 1/2007 | Bolin | |
| 2007/0046393 | A1 | 3/2007 | Quan et al. | |
| 2007/0096919 | A1 | 5/2007 | Knadle, Jr. et al. | |
| 2007/0258676 | A1 | 11/2007 | Windover | |
| 2008/0191946 | A1 | 8/2008 | Gustaf | |
| 2008/0292035 | A1 | 11/2008 | Chang | |
| 2009/0153410 | A1 * | 6/2009 | Chiang et al. | 343/702 |
| 2009/0251377 | A1 | 10/2009 | Peng et al. | |
| 2010/0053002 | A1 | 3/2010 | Wojack et al. | |
| 2010/0141551 | A1 | 6/2010 | Peng | |
| 2010/0315303 | A1 | 12/2010 | Kearney et al. | |
| 2011/0043301 | A1 | 2/2011 | Huettner | |
| 2011/0057852 | A1 | 3/2011 | Holland et al. | |
| 2011/0074649 | A1 | 3/2011 | Isom et al. | |
| 2011/0128199 | A1 | 6/2011 | He et al. | |
| 2011/0175787 | A1 | 7/2011 | Malak et al. | |
| 2011/0235755 | A1 | 9/2011 | Yang et al. | |
| 2012/0071214 | A1 | 3/2012 | Ash, Jr. et al. | |
| 2012/0146869 | A1 | 6/2012 | Holland et al. | |
| 2012/0200468 | A1 | 8/2012 | Cooper et al. | |
| 2012/0200469 | A1 | 8/2012 | Cooper et al. | |
| 2012/0200470 | A1 | 8/2012 | Cooper et al. | |
| 2012/0206303 | A1 | 8/2012 | Desclos et al. | |
| 2012/0281162 | A1 | 11/2012 | Chen et al. | |
| 2012/0313832 | A1 | 12/2012 | Pazin et al. | |
| 2012/0320506 | A1 | 12/2012 | Bentz et al. | |
| 2013/0035050 | A1 | 2/2013 | Gao et al. | |
| 2013/0169487 | A1 | 7/2013 | Liang et al. | |
| 2013/0187816 | A1 | 7/2013 | Chung et al. | |
| 2014/0055315 | A1 | 2/2014 | Cooper et al. | |
| 2014/0097997 | A1 | 4/2014 | Chang | |
| 2014/0118210 | A1 | 5/2014 | Cooper et al. | |
| 2014/0118211 | A1 | 5/2014 | Cooper et al. | |
| 2014/0333497 | A1 | 11/2014 | Cooper | |
| 2014/0354485 | A1 | 12/2014 | Cooper | |
| 2015/0222008 | A1 | 8/2015 | Cooper | |
| 2015/0333394 | A1 | 11/2015 | Nash et al. | |
| 2015/0340768 | A1 | 11/2015 | Rucker et al. | |
| 2015/0349401 | A1 | 12/2015 | Nash | |

FOREIGN PATENT DOCUMENTS

| | | | |
|---|---|---|---|
| FR | 2785476 | | 5/2000 |
| JP | 59005705 | A | 1/1984 |
| KR | 100703221 | | 4/2007 |
| KR | 1020070062187 | A | 6/2007 |
| KR | 1020130095451 | | 8/2013 |
| KR | 1020140089307 | | 7/2014 |
| RU | 2211509 | C2 | 8/2003 |
| RU | 2327263 | C2 | 6/2008 |
| RU | 2380799 | | 1/2010 |
| RU | 2400876 | | 9/2010 |
| WO | WO 1998/20578 | A1 | 5/1998 |
| WO | WO 2003/098732 | A1 | 11/2003 |
| WO | WO 2007/036607 | A1 | 4/2007 |
| WO | WO 2012/058753 | A1 | 5/2012 |
| WO | WO 2012/109392 | A1 | 8/2012 |
| WO | WO 2012/109393 | A1 | 8/2012 |
| WO | WO 2012/109498 | A1 | 8/2012 |
| WO | WO 2013/063335 | A1 | 5/2013 |
| WO | WO 2014/011943 | A1 | 1/2014 |
| WO | WO/2014/043401 | A1 | 3/2014 |
| WO | WO/2014/047211 | A1 | 3/2014 |
| WO | WO 2014/047567 | A1 | 3/2014 |
| WO | WO 2015/171963 | A1 | 11/2015 |
| WO | WO 2015/175550 | A1 | 11/2015 |
| WO | WO 2015/176064 | A1 | 11/2015 |
| WO | WO 2015/184469 | A2 | 12/2015 |
| WO | WO 2016/01176 | A1 | 1/2016 |
| WO | WO 2016/007958 | A2 | 1/2016 |
| WO | WO 2016/011181 | A1 | 1/2016 |

OTHER PUBLICATIONS

Sievenpiper D., et al., "Low-Profile, Four-Sector Diversity Antenna on High-Impedance Ground Plane", Electronics Letters, IEE Stevenage, GB, vol. 36, No. 16, Aug. 3, 2000, pp. 1343-1345.

* cited by examiner

HIGH GAIN FREQUENCY STEP HORN ANTENNA

This application claims priority to U.S. Provisional Patent Application No. 61/440,598 filed on Feb. 8, 2011 which is to be consider included herein in its entirety by this reference.

BACKGROUND OF THE INVENTION

1. Field of the Invention

The present invention relates to antennas for transmission and reception of radio frequency communications. More particularly to an antenna employing one or a plurality of planar radiator elements which are configured to extend the bandwidth in the lower frequencies of the wideband antenna. This extended lower frequency attenuation is enabled by using notched edges to yield a slow wave structure to the narrowing cavity of the element. The device is especially well adapted for broadband communications using the disclosed radiator elements which are employable individually or engageable to other similarly configured antenna elements with stepped edges allowing for an increase in the bandwith of the formed element.

2. Prior Art

Conventionally, cellular, radio, and television antennas are formed in a structure that may be adjustable for frequency and gain by changing the formed structure elements. Shorter elements are used for higher frequencies, longer elements for lower, and pluralities of similarly configured shorter and longer elements are used to increase gain or steer the beam. Such elements are conventionally dipole elements either fixed to a Yagi style antenna, rabbit ears, or other configurations.

However, a conventional formed antenna structure or node itself is generally fixed in position but for the dipole or other style radiator elements which may be adjusted for length or angle to better transmit and receive on narrow band frequencies of choice in a location of choice to serve certain users of choice.

With modern communications enabling more use of more and more areas of the RF spectrum, many communications firms employ many different frequencies, for many different types of communications and devices. The result being that many different such individual antenna towers are required due to the plurality of providers, and the plurality of different frequencies of each provider and/or each type of communication. The results in one and generally a plurality of such towers, each having dipole or other radiator elements upon them, in sizes to match the individual frequencies employed by the provider for different services such as WiFi, television, or cellular phones or police radios. This frequently results in multiple such antenna towers, within yards of each other, on hills, or other high points servicing surrounding areas. Such duplication of effort is not only expensive but tends to be an eyesore in the community.

Conventionally, when constructing a communications array such as a cellular antenna grid or a wireless communications web, the builder is faced with the dilemma. The plurality of different frequencies for the different RF bands require the obtaining of multiple antennas which are customized by antenna providers for the narrow frequency to be serviced. Most such antennas are custom made using dipole type radiator elements to match the narrow band of frequencies to be employed at the site which can vary widely depending on the network and venue.

The problem for the site builder and operator is further complicated if a horizontal, vertical, or circular RF polarization scheme is desired to either increase bandwidth or available connections. Further consideration must be given to the gain at the chosen frequency and thereafter the numbers elements included in the final structure to meet the gain requirements and possible beam steering requirements.

However, such antennas, once manufactured to specific individual frequencies or narrow frequency bands, offer little means of adjustment of their final frequency range and their gain since they are generally fixed in nature. Further, since they are custom manufactured to the frequency band, gain, polarization, beam width, and other requirements, should technology change or new frequencies become available, it can be a problem since new antennas are required to match the changes.

Still further, for a communications system provider, working on many different bands with many frequencies in differing wireless cellular or grid communications schemes, a great deal of inventory of the various antennas for the plurality of frequencies employed at the desired gains and polarization schemes must be maintained. Without stocking a large inventory of antennas, delays in installation can occur. Such an inventory requirement increases costs tremendously as well as deployment lead time if the needed antenna configuration is not at hand.

Additionally, during installation, it is hard to predict the required final antenna construction configuration since in a given topography, what works on paper may not work in the field. This is further complicated should exact gain and polarization or frequency range which may be required for a given system being installed, should it not match predictions. The result being that a delay will inherently occur where custom antennas must be manufactured for the user if they are not stocked.

This is especially true in cases where a wireless grid or web is being installed for wireless communications such as radios, internet, or cell phones. The frequencies can vary widely depending on the type of wireless communications being implemented in the grid, such as cellular or WiFi or digital communications for emergency services. The system requirements for gain and individual employed frequencies can also vary depending on the FCC and client's needs.

Still further, the infrastructure required for conventional commercial broadcast and receiving cellular, radio and other antennas, require that each antenna at each site, be hardwired to the local communications grid. This not only severely limits the location of individual antenna nodes in such a grid, it substantially increases the costs since each antenna services a finite number of users and it must be hardwired to a local network on the ground.

As such, there is a continuing unmet need for an improved antenna element, providing an improved device and method of antenna tower or node construction, allowing for easy formation and configuration of a radio antenna for two way communications such as cellular or radio for police or emergency services. Such a device would be best if modular in nature and employ individual radiator elements which provide a very high potential for the as-needed configuration for specific frequency gain, frequency rejection, polarization, direction, steering and other factors desired, in an antenna grid servicing multiple but varying numbers of users over a day's time.

Such a device should employ wideband antenna elements allowing for a maximizing of both transmission and receipt of communications between a high and low frequency limit of the element. The components, so assembled, should provide electrical pathways electrically communicated in a standardized connection to transceivers. Such a device should employ a single antenna element capable of providing for a wide range of different frequencies to be transmitted and received. Such a device, by using a plurality of individual antenna elements of substantially identical construction, should be switchable in order to increase or decease gain and steer the individual communications beams.

Employing a plurality of individual wideband antenna elements, such a device should enable the capability of forming antenna sites using a kit of individual antenna element components, each of which are easily engageable with the base components. These individual antenna element components should have electrical pathways which easily engage those of the base components of the formed antenna to allow for snap-together or other easy engagement to the base components hosting the antenna elements. Such a device should be capable of concurrently achieving a switchable electrical connection from each of the individual antenna elements across the base components and to the transceiver in communication with one or a plurality of the antenna elements.

SUMMARY OF THE INVENTION

The device and method herein disclosed and described achieves the above-mentioned goals through the provision of a single antenna element which is uniquely configured to provide excellent transmission and reception capability for a wide bandwidth of individual respective frequencies between a high and low limit. Transmission and reception in any frequency between the highest and lowest is significantly enhanced. Further, by employing a stepped edge on the edges of the nodes forming the cavity of the element, additional and enhanced bandwidth is possible as the notches provided a means for optimization of bandwith in the lower received frequencies which the radiator element is configured to provide.

The antenna element of the disclosed device provides excellent performance and high gain for selected frequencies withing the range of frequencies of the radiator element. Consequently, the single antenna element herein disclosed, is capable of concurrent reception and transmission in any of the frequencies between a high and low limit, rather than at a single or small plurality as is conventionally available.

While employable in individual elements, the antenna element may also be coupled into arrays for added gain and beam steering. The arrays may be adapted for multiple configurations using software adapted to the task of switching between antenna elements to form or change the form of engaged arrays of such elements. Using antenna elements, each substantially identical to the other and each capable of RF transmission and reception across a wide array of frequencies to form an array antenna, the device provides an elegantly simple solution to forming antennas which are highly customizable for frequency, gain, polarization, steering, and other factors, for that user.

The antenna element of the disclosed device herein is based upon a planar design forming a planar antenna element formed by printed-circuit technology. The antenna element is of two-dimensional construction forming what is known as a horn or notch antenna type. The element is formed of a pair of lobes on a dialectic substrate of such materials as MYLAR, fiberglass, REXLITE, polystyrene, polyamide, TEFLON, fiberglass or any other such material suitable for the purpose intended. The substrate may be flexible whereby the antenna can be rolled up for storage and unrolled into a planar form for use. Or, in a particularly preferred mode of the device herein, it is formed on a substantially rigid substrate material in the planar configuration thereby allowing for components that both connect and form the resulting rigid antenna structure.

The antenna element itself, formed of the planar conductive material situated upon the substrate, can be any suitable conductive material, as for example, aluminum, copper, silver, gold, platinum or any other electrically conductive material suitable for the purpose intended. The conductive material forming the element is adhered to the substrate by any known technology.

In a particularly preferred embodiment, the antenna element is of planar conductive material positioned on a first side of the dialectic substrate. The thickness of the conductive material is currently between 2 to 250 mils thick and is formed to define a non-plated first cavity or covered surface area, in the form of a horn having a decreasing cross section and stepped edges along the decreasing diameter. The formed horn has the general appearance of two lobes or half-sections in a substantially mirrored configuration extending from a center to a widest point at lobe tips. Particularly preferred is the employment of steps or notches which increases the performance in the lower frequencies of the antenna bandwidth.

The cavity defined by the uncoated or unplated surface area of the substrate between the two halves or lobes, forms a mouth of the antenna and terminating at two opposing distal tip points on each lobe or half-section of the tail shaped antenna element. The center of the cavity extends substantially perpendicular to a horizontal line running between the two distal tip points and extends in discrete mirrored steps formed into the edge of the lobes or element halves at their intersection with the uncovered area of the cavity.

Along the cavity pathway, from the distal tip points of the element halves, the cavity narrows slightly in its cross sectional area in these discrete steps. The cavity is at a widest point between the two distal end points and narrows to a narrowest point. The cavity from this narrow point curves in a curvilinear portion, to extend to a distal end within the one lobe half.

The widest point of the cavity between the distal end points of the antenna halves determines the low point for the frequency range of the antenna element. The narrowest point of the cavity between the two halves determines the highest frequency to which the element is adapted for use. Currently a particularly favored widest distance is between 1.4 and 1.6 inches with 1.5812 inches being a particularly preferred widest distance. The narrowest current favored point is between 0.024 and 0.026 inches with 0.0253 being particularly preferred when paired with the 1.5812 width.

Of course those skilled in the art will realize that by adjusting the widest and narrowest distances of the formed cavity, the element may be adapted to other frequency ranges and any antenna element which employs two substantially identical leaf portions to form a cavity therebetween with maximum and minimum widths is anticipated within the scope of the claimed device herein. Similarly, the position and depth of the discrete steps along the cavity pathway can be selectively oriented to determine which specific frequencies are accepted and at what gain.

On the opposite surface of the substrate from the formed antenna element, extending to a distal end within a circular portion of the curvilinear section, a feedline extends from the area of the cavity intermediate the first and second halves of the antenna element and passes through the substrate to a tap position to electrically connect with the antenna element which has the cavity extending therein to the distal end perpendicular extension.

The location of the feedline connection, the size and shape of the two halves of the antenna element, and the cross sectional area of the cavity may be of the antenna designers choice for best results for a given use and frequency. However, because the disclosed antenna element performs so well, across such a wide bandwidth, the current mode of the antenna element as depicted herein, with the connection point shown, within the circular area of the curvilinear area, is especially preferred. Additionally useful is the employment of a meanderline section of the feedline at its distal end. Of course those skilled in the art will realize that shape of the half-portions and size and shape of the cavity may be adjusted to increase gain in certain frequencies or for other reasons known to the skilled, and any and all such changes or alterations of the depicted antenna element as would occur to those skilled in the art upon reading this disclosure are anticipated within the scope of this invention.

Because of this unique shape rendering the antenna element adept at transmitting and receiving across selectively desired frequencies, each such antenna element is easily combined with others of identical shape to increase gain and steer the beam of the formed antenna.

As such, those skilled in the art will appreciate that the pioneering conception of such an antenna element formed on a substrate and with a cavity between two halves with specific step to yield a band coverage of desired discrete frequencies and used singularly or in combination in the kit-like component method to form an array upon which this disclosure is based, may readily be utilized as a basis for designing of other antenna structures, methods and systems for carrying out the several purposes of the present disclosed device. It is important, therefore, that the claims be regarded as including such equivalent construction and methodology insofar as they do not depart from the spirit and scope of the present invention.

It is one principal object of this invention to provide an antenna element which transmits and receives radio waves across specific frequencies and at high gain, in a single element, and therefore eliminates the need for other differently shaped or lengthened elements.

It is a further object of this invention to provide enhanced portion of bandwith between the high and low limits of the element through stepping the edges.

BRIEF DESCRIPTION OF DRAWING FIGURES

DETAILED DESCRIPTION OF THE PREFERRED EMBODIMENTS OF THE INVENTION

Figure 1:
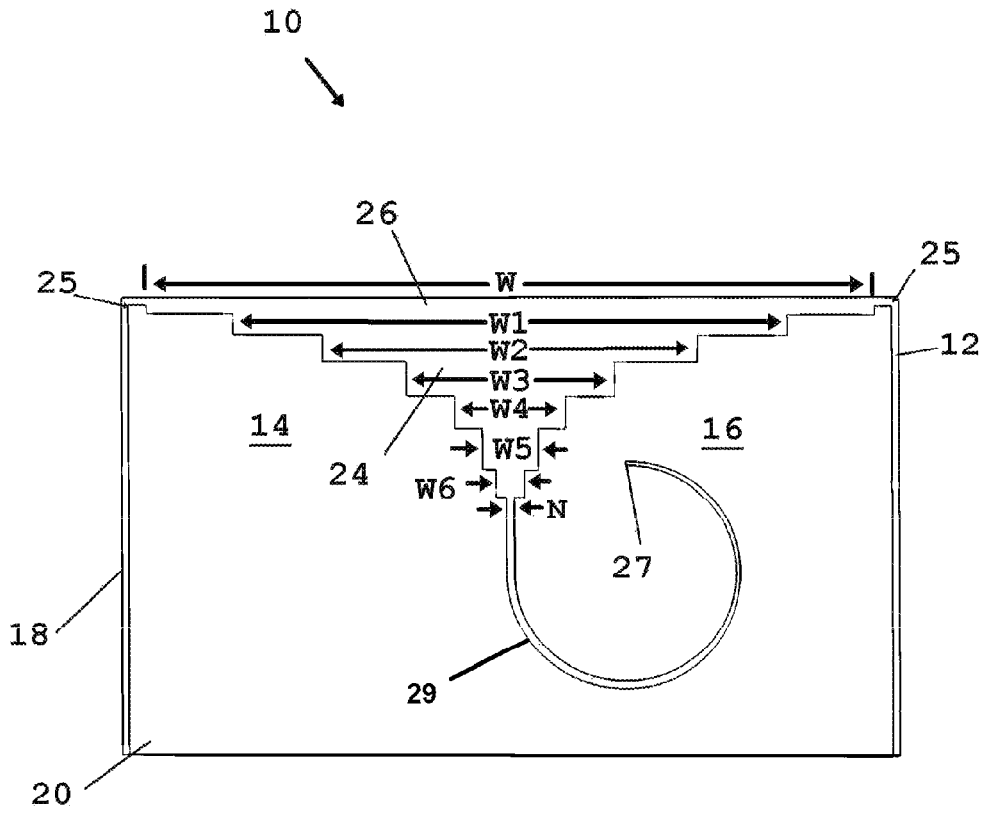
FIG. 1 shows a top plan view of an element according to the invention herein having stepped or notched edges narrowing along two lobes of the element.

Referring now to the drawings of FIGS. 1-4, in FIG. 1 there is depicted the antenna element 12 of the device 10. As shown, the antenna element 12 is formed with two halves or lobes 14 and 16. The first lobe 14 and second lobe 16 are preferably substantially identical or mirror images of each other.

Also shown are discrete steps W1-W6, formed in the edge of the lobes 14 and 16 along a declining slope of the cavity 24 formed between the first lobe 14 and second lobe 16. The antenna element 12 is formed of planar conductive material upon a dielectric substrate 18 which as noted is nonconductive and may be constructed of either a rigid or flexible material such as, MYLAR, fiberglass, REXLITE, polystyrene, polyamide, TEFLON fiberglass, or any other such material which would be suitable for the purpose intended.

The conductive material 20 is engaged with the dialectic material by microstripline or the like or other metal and substrate construction well known in this art. Any means for affixing the conductive material 20 to the substrate 18 is acceptable to practice this invention. The conductive material 20 as for example, includes but is not limited to aluminum, copper, silver, gold, platinum or any other electrically conductive material which is suitable for the purpose intended.

As shown in FIG. 1 the surface conductive material 20 formed upon a first surface of the dialectic substrate 18 is etched away or removed by suitable means or left uncoated in the coating process, so as to form the first and second lobes 14 and 16 which define the cavity 24 and the cavity mouth 26.

The cavity 24 extending from the mouth 26 has a widest point "W" and extends in discrete steps W1, W2, W3, W4, W5, W6 along the edges of the two lobes 14 and 16 as the cavity narrowed to a narrowest point "N" which is substantially equidistant between the two distal tips 25. The center of the narrowest point or gap, is also positioned along an imaginary line substantially perpendicular to the line depicting the widest point "W" running between the two distal tips 25 on the two lobes 14 and 16.

The widest distance "W" of the mouth 26 portion of the cavity 24 running between the distal end points 25 of the antenna halves or lobes 14 and 16 determines the low point for the frequency range of the device 10. Intermediate discrete steps W1 through W6 are selectively positioned in mirrored positions along the edges of the two lobes, and serve to increase the bandwith and through enhancement of the transmission and reception of the element in the lower frequencies in which the formed antenna element is capable of operation.

The narrowest distance "N" opposite the mouth 26 portion of the cavity 24 between the two lobes 14 and 16 determines the highest frequency to which the device 10 is adapted for use. The widest distance "W" is determined based on the lowest frequency desired. The element can concurrently transmit and receive at any frequency between the highest and lowest frequency when electronically engaged with a transceiver or the like adapted for such multiple concurrent use.

Of course, those skilled in the art will realize that by adjusting the widest and narrowest distances as well as the location and distance of the steps on the formed cavity, the element may be adapted to capture a signal better and the lower end of the frequencies of the element, and any antenna element which employs two substantially identical leaf portions to form a cavity therebetween with maximum and minimum widths and intermediate steps is anticipated within the scope of the claimed device herein.

The cavity 24 proximate to the narrowest distance "N" between the edges of the lobes 14 and 16, curves into a curvilinear portion 29 into the body portion of the second lobe 16 and extends away from the other lobe 14. The curvilinear portion 29 of the cavity 24 then extends to a distal end 27 within the first lobe 14. Adjusting the size and total area of the void in the conductor material 20 defining the cavity 24 provides a means for impedance matching in the element by increasing or decreasing the "L" in an LC Impedance matching scheme and maximize performance. The curvilinear portion 29 can be extended or lessened to fine tune this matching.

Figure 2:
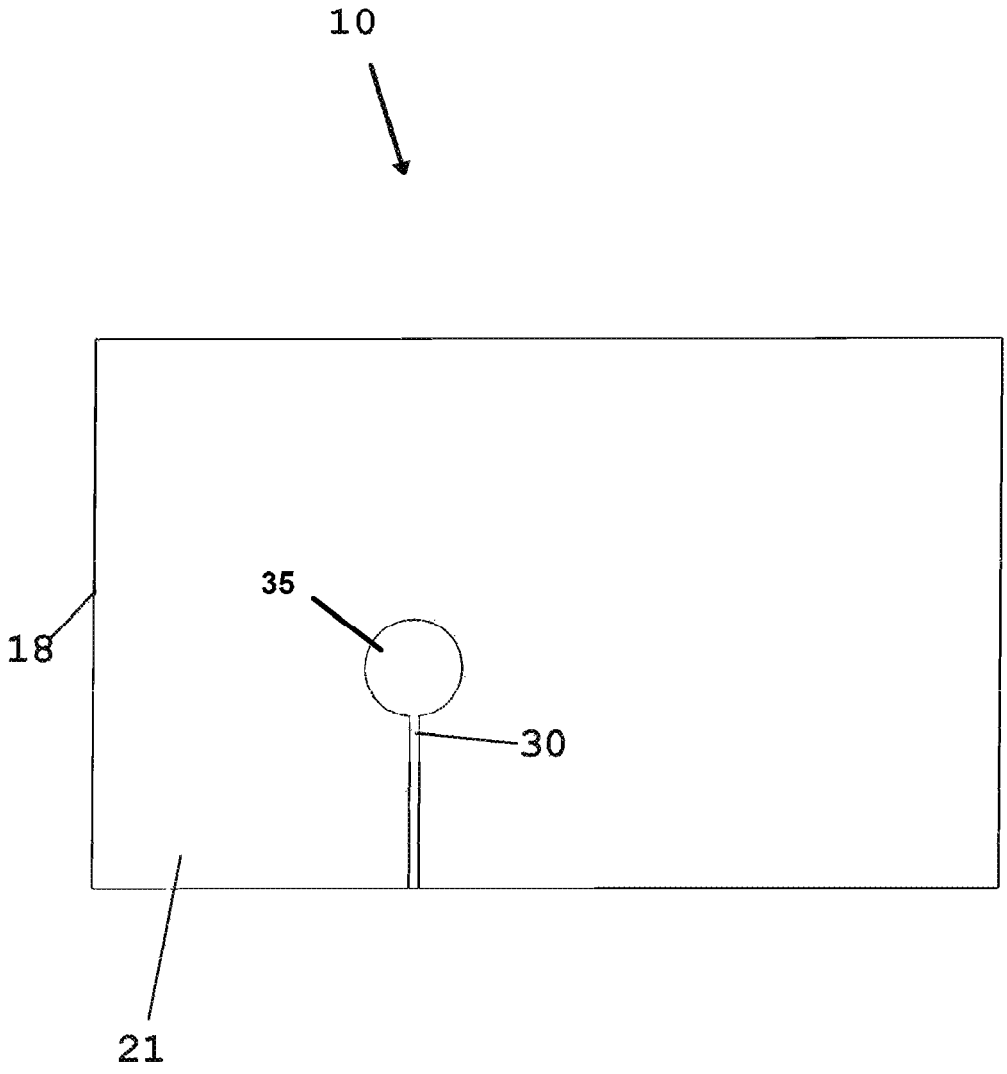
FIG. 2 shows one mode of feed line placement on the opposite side surface of the dielectric substrate from the element and the positioning a ball shaped portion to be within a circular portion of the curvilinear cavity.

On the opposite surface 21 of the substrate 18 shown in FIG. 2, a feedline 30 extends from the area of the cavity 24 intermediate to the two lobes 14 and 16 forming the two halves of the antenna element 12 and passes through the substrate 18 to electrically connect to the first lobe 14 adjacent to the edge of the curvilinear portion 29 of the cavity 24 past the narrowest distance "N." A ball shaped portion 35 is positioned at the distal end of the feedline 30 and is centered within the circular shape of the curvilinear portion 29 and has found to enhance reception and transmission characteristics.

The location of the feedline 30 connection, the size and shape of the two lobes 14 and 16 of the antenna element 12 and the cross sectional area of the widest distance "W", subsequent discrete step distances W1-W6 to enhance lower end reception, and narrowest distance "N" of the cavity 24 may be of the antenna designers choice for best results for a given use and frequency.

Figure 3:
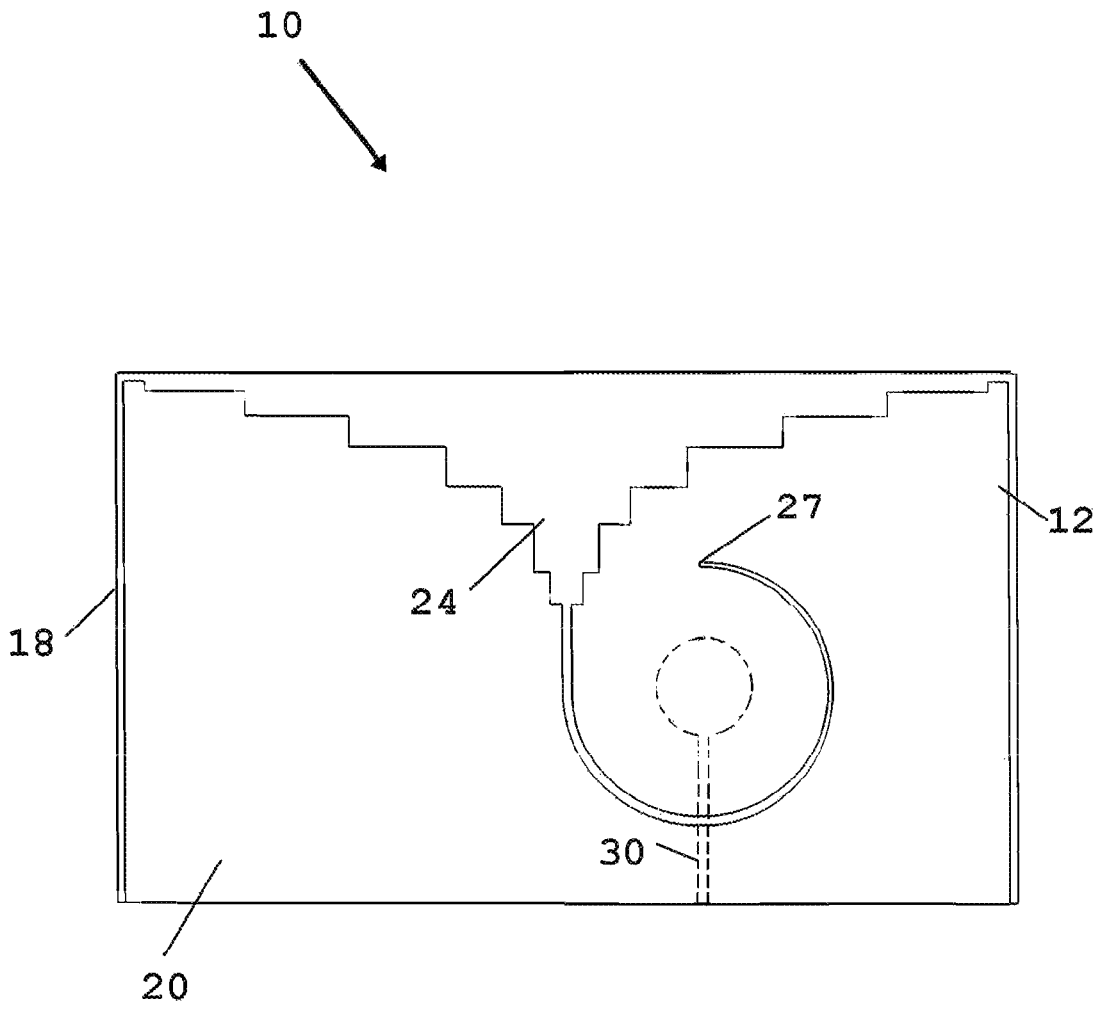
FIG. 3 shows the element side of the dielectric substrate and the positioning of the feed line for optimum operation with the ball shaped portion centrally located within the curvilinear portion of the cavity.
Figure 4:
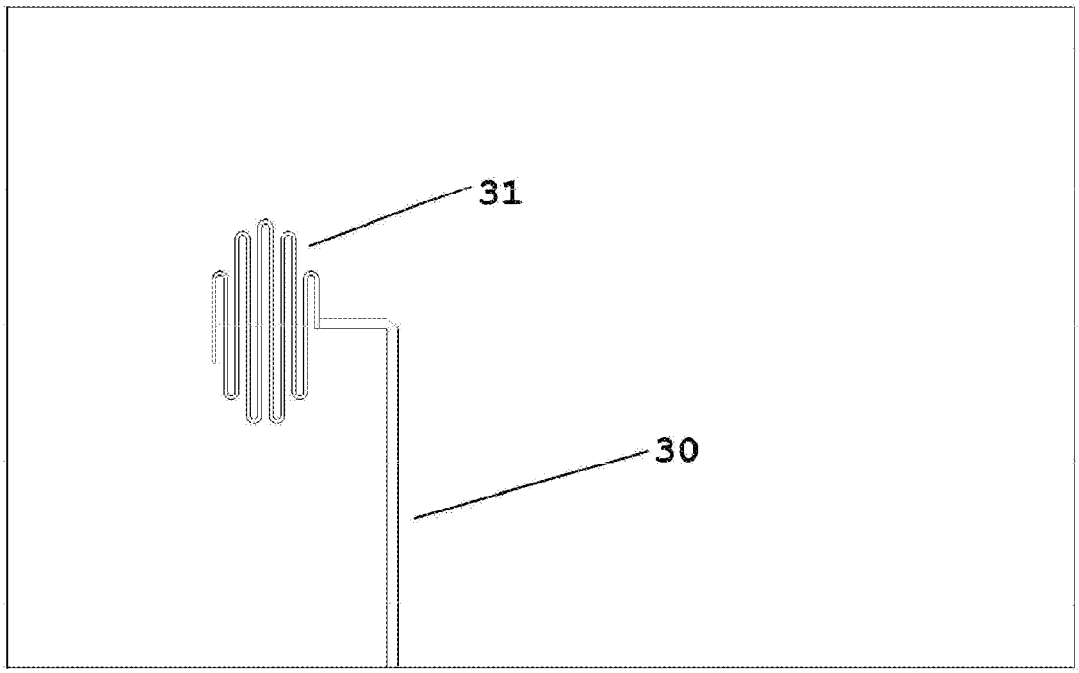
FIG. 4 shows a second mode of the feedline having a meanderline located at its distal end to aid in impedance matching of the device and to provided a second band of frequencies from the meanderline section.

To better understand the location and orientation of the feedlines 30 relative to the cavity 24 another top plan view of the first surface 20 is seen in FIG. 3 with the feedlines 30 engaged on the second surface 21 depicted by a dashed line. FIG. 4 shows a second mode of the feedline having a meanderline 31 distal end to aid in impedance matching of the device. The meanderline 31 portion also is an antenna on its own and is adapted to receive and transmit in frequencies determined by the legs of the meanderline 31 and provides a secondary signal source from that of the cavity.

FIG. 4 shows a second mode of the feedline 30 having a meanderline 31 distal end to aid in impedance matching of the device. The meanderline 31 portion provides the "L" for LC impedance matching of the formed element to maximize performance and can be lengthened or shortened to adjust that variable. This change in length can also be provided to change the frequency of the second signal source provided by the meanderline 31 portion.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A passive radiator element for RF communications, comprising:

a planar dielectric substrate, said dielectric substrate defined by a periphery including a left and right vertical side and an upper and lower horizontal side;

a first substrate surface of said dielectric substrate, a portion of which is covered with a conductive material and a portion of which is uncovered;

said conductive material forming a pair of lobes having substantially identical mirror-image shapes;

said lobes having respective opposing linear first side edges extending on opposite sides of a cavity of said uncovered substrate surface;

said lobes extending in opposite directions to respective distal tips;

said distal tips defined by an inner and outer vertical side and a horizontal side;

said cavity having a mouth portion, said mouth portion beginning at a first edge, along a line extending between said distal tips;

said mouth having a widest portion defined by a distance between said inner vertical side of each distal tip;

said cavity reducing in cross-section from said first edge as it extends to a narrowest point substantially centered between said pair of lobes;

notches formed in opposing positions along both of said respective linear first side edges, said notches providing means for enhanced reception of frequencies specific to distances between respective pairs of said notches in said respective opposing positions;

said pair of lobes including a first lobe and a second lobe;

a continuously curved portion of said cavity extending from proximal said narrowest point into said second lobe, wherein said continuously curved portion extends in excess of 180 degrees to form a substantially circular configuration; and a feedline located at a second substrate surface, wherein said second substrate surface is opposite said first substrate surface, wherein said feedline comprises a substantially circular portion that is positioned within said substantially circular configuration, and wherein said feedline is configured to electrically communicate at a first end with said second lobe and adapted at a second end for electrical communication with an RF receiver or transceiver.

2. The passive radiator element of claim 1, wherein said substantially circular portion is substantially centered within said substantially circular configuration.

3. The passive radiator element of claim 2, wherein said substantially circular portion comprises a meanderline shaped portion, said meanderline shaped portion forming a second element for transmission and reception of said RF communications.

4. The radiator element of claim 1, additionally comprising:

said notches formed in a plurality of said opposing positions; and said plurality of said opposing positions being between two and six.

5. The passive radiator element of claim 2, additionally comprising:

said notches formed in a plurality of said opposing positions; and said plurality of said opposing positions being between two and six.

6. The passive radiator element of claim 3, additionally comprising:

said notches formed in a plurality of said opposing positions; and said plurality of said opposing positions being between two and six.

7. The passive radiator element of claim 1, wherein said cavity also extends from said first edge of said mouth portion in an opposite direction, said cavity extending in said opposite direction toward each of said first lobe and said second lobe, first in a horizontal direction between each of said distal tips located on each of said first and second lobes and said upper horizontal side of said periphery of said dielectric substrate and then extending in a vertical direction between each of said dielectric substrate left and right vertical sides and an outer vertical edge of each of said first and second lobes, said cavity extending in said opposite direction in said vertical direction terminating where a portion of each of said cavity extending in said opposite direction and extending in said vertical direction meets said lower horizontal side.

8. The passive radiator element of claim 4, wherein said plurality of said opposing positions is six.

9. The passive radiator element of claim 1, wherein said distance of said widest portion of said mouth is between 1.4 and 1.6 inches and wherein a distance of said narrowest point substantially centered between said pair of lobes is between 0.024 and 0.026 inches.

10. The passive radiator element of claim 9, wherein said curved portion of said cavity extends in a curvilinear fashion to form a substantially circular portion, said substantially circular portion of said continuously curved portion of said cavity is further defined by a width between an inner circular edge and an outer circular edge of said substantially circular portion of said continuously curved portion of said cavity, said width of said substantially circular portion of said continuously curved portion being substantially the same as said distance of said narrowest point.

11. The passive radiator element of claim 1, wherein said dielectric substrate is formed of a material which is flexible such that said passive radiator element is capable of being rolled-up for storage and then unrolled to a planar shape.

12. The passive radiator element of claim 11, wherein said dielectric material is one of a group of materials consisting of Mylar, fiberglass, Rexlite, polystyrene, polyamide and Teflon.

13. A radiator element for RF communications, comprising:

a planar dielectric substrate, said dielectric substrate defined by a periphery including a left and right vertical side and an upper and lower horizontal side;

a first substrate surface of said dielectric substrate, a portion of which is covered with a conductive material and a portion of which is uncovered;

said conductive material forming a pair of lobes having substantially identical mirror-image shapes;

said lobes having respective opposing linear first side edges extending on opposite sides of a cavity of said uncovered substrate surface;

said lobes extending in opposite directions to respective distal tips;

said respective distal tips defined by an inner and outer vertical side and a horizontal side;

said cavity having a mouth portion, said mouth portion beginning at a first edge, along a line extending between said respective distal tips;

said mouth having a widest portion defined by a distance between said inner vertical sides of each distal tip;

said cavity reducing in cross-section from said first edge as it extends to a narrowest point substantially centered between said pair of lobes;

notches formed in opposing positions along both of said respective linear first side edges, said notches providing means for enhanced reception of frequencies specific to distances between respective pairs of said notches in said respective opposing positions; and a continuously curved portion of said cavity extending in excess of 180 degrees to form a substantially circular configuration; and a feedline located at a substrate surface that is opposite said first substrate surface, wherein said feedline comprises a substantially circular portion that is positioned within said substantially circular configuration, and wherein said feedline is configured to electrically communicate at a first end with one of said pair of said lobes and adapted at a second end for electrical communication with an RF receiver or transceiver.

14. The radiator element of claim 13, wherein said cavity also extends from said first edge of said mouth portion in an opposite direction, said cavity extending in said opposite direction toward each of said pair of lobes, first in a horizontal direction between each of said distal tips located on each of said pair of lobes and said upper horizontal side of said periphery of said dielectric substrate and then extending in a vertical direction between each of said dielectric substrate left and right vertical sides and an outer vertical edge of each of said pair of lobes, said cavity extending in said opposite direction in said vertical direction terminating where a portion of each of said cavity extending in said opposite direction and extending in said vertical direction meets said lower horizontal side.

15. The radiator element of claim 13, wherein said distance of said widest portion of said mouth is between 1.4 and 1.6 inches and wherein a distance of said narrowest point substantially centered between said pair of lobes is between 0.024 and 0.026 inches.

16. The radiator element of claim 13, wherein said dielectric substrate is formed of a material which is flexible such that said passive radiator element is capable of being rolled-up for storage and then unrolled to a planar shape and further wherein said dielectric material is one of a group of materials consisting of Mylar, fiberglass, Rexlite, polystyrene, polyamide and Teflon.

17. A passive radiator element for RF communications, comprising:

a planar dielectric substrate, said dielectric substrate defined by a periphery including a left and right vertical side and an upper and lower horizontal side;

a first substrate surface of said dielectric substrate, a portion of which is covered with a conductive material and a portion of which is uncovered;

said conductive material forming a pair of lobes having substantially identical mirror-image shapes;

said lobes having respective opposing linear first side edges extending on opposite sides of a cavity of said uncovered substrate surface;

said lobes extending in opposite directions to respective distal tips;

said cavity having a mouth portion, said mouth portion beginning at a first edge, along a line extending between said distal tips;

said cavity reducing in cross-section from said first edge as it extends to a narrowest point substantially centered between said pair of lobes;

notches formed in opposing positions along both of said respective linear first side edges, said notches providing means for enhanced reception of frequencies specific to distances between respective pairs of said notches in said respective opposing positions;

said pair of lobes including a first lobe and a second lobe;

a continuously curved portion of said cavity extending from proximal said narrowest point into said second lobe, wherein said continuously curved portion extends in excess of 180 degrees to form a substantially circular configuration; and a feedline located at a second substrate surface, wherein said second substrate surface is opposite said first substrate surface, wherein said feedline comprises a substantially circular portion that is positioned within said substantially circular configuration, and wherein said feedline is configured to electrically communicate at a first end with said second lobe and adapted at a second end for electrical communication with an RF receiver or transceiver.

18. The passive radiator element of claim 17, wherein said cavity also extends from said first edge of said mouth portion in an opposite direction, said cavity extending in said opposite direction toward each of said first lobe and said second lobe, first in a horizontal direction between each of said distal tips located on each of said first and second lobes and said upper horizontal side of said periphery of said dielectric substrate and then extending in a vertical direction between each of said dielectric substrate left and right vertical sides and an outer vertical edge of each of said first and second lobes, said cavity extending in said opposite direction terminating where a portion of each of said cavity extending in said opposite direction and extending in a vertical direction meets said lower horizontal side.

* * * * *